US007942654B2

(12) United States Patent
Chang

(10) Patent No.: US 7,942,654 B2
(45) Date of Patent: May 17, 2011

(54) ADDRESSABLE MULTI-CHANNEL PERISTALTIC PUMP

(75) Inventor: James Chang, Carlsbad, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 857 days.

(21) Appl. No.: 11/833,493

(22) Filed: Aug. 3, 2007

(65) Prior Publication Data

US 2009/0035165 A1 Feb. 5, 2009

(51) Int. Cl.
*F04B 43/08* (2006.01)
*F04B 43/12* (2006.01)
*F04B 45/06* (2006.01)

(52) U.S. Cl. ..... 417/474; 417/223; 417/429; 417/475; 417/477.1; 417/216

(58) Field of Classification Search ..... 417/216, 417/223, 429, 474, 475, 476, 477.1, 477.3, 417/477.6

See application file for complete search history.

(56) References Cited

U.S. PATENT DOCUMENTS

| | | | | |
|---|---|---|---|---|
| 4,365,943 | A * | 12/1982 | Durrum | 417/429 |
| 4,441,867 | A | 4/1984 | Berelson | |
| 4,515,584 | A * | 5/1985 | Abe et al. | 604/66 |
| 5,846,061 | A | 12/1998 | Ledebuhr et al. | |
| 6,203,296 | B1 | 3/2001 | Ray et al. | |
| 6,491,368 | B1 | 12/2002 | Cipolla | |
| 7,140,850 | B2 | 11/2006 | Otis, Jr. | |
| 7,144,231 | B2 | 12/2006 | Davis | |
| 2003/0215957 | A1 | 11/2003 | Lemmo | |
| 2007/0148022 | A1 * | 6/2007 | Cheng | 417/477.1 |

FOREIGN PATENT DOCUMENTS

| | | |
|---|---|---|
| WO | 9911932 | 3/1999 |

OTHER PUBLICATIONS

International Search Report received in PCT/US2008/071570, mailing date Nov. 26, 2008, 15 pp.

* cited by examiner

*Primary Examiner* — Devon C Kramer
*Assistant Examiner* — Christopher Bobish

(57) ABSTRACT

The present invention provides an addressable multi-channel peristaltic pump. According to the invention, this pump design allows for selection and operation of one or more pump heads on a drive shaft, while locking other non-selected pump heads in a stationary position. It is possible to operate the multi-channel pump using a limited number of motors, preferably two motors: a selector motor and a dispense motor. Thus, the pump provides for pumping or dispensing of one or more fluids without the need for multiple pumps. Likewise, compared with typical single motor multi-channel systems, where all pump heads on the drive shaft must rotate at the same time, the present invention provides for selective dispensing of one or more fluids. The pumps of the present invention are suitable for any multiple fluid transfer application, including in automated multi-channel reagent dispensing systems, such as nucleic acid purification systems.

19 Claims, 16 Drawing Sheets

ADDRESSABLE MULTI-CHANNEL PERISTALTIC PUMP

BACKGROUND OF THE INVENTION

1. Field of the Invention

The present invention relates generally to the field of multi-channel pumps. More particularly, the present invention relates to multi-channel pumps, wherein one or more fluids, including liquids, gases, and reagents can be selectively dispensed. Further, the present invention relates to addressable multi-channel peristaltic pumps.

2. Description of Related Art

Peristaltic pumps are used in a variety of applications, including in automated multi-channel reagent dispensing systems, for example, nucleic acid purification systems. Indeed, peristaltic pumps are useful for any multiple fluid transfer application, especially fluid transfer applications that would benefit from isolation of fluid from the system and other fluids.

Typically, peristaltic pumps comprise a mechanism for transporting fluid within flexible tubing by applying pressure to the tubing at select intervals. As positive pressure is applied to the tubing, fluid in the tubing is moved or "pushed" forward. As the positive pressure point is moved forward on the tubing, a negative pressure is created behind the point of pressure, thus, causing fluid behind the pressure point to be drawn into and "pulled" forward through the tubing. The mechanism for causing the fluid to move within the tubing can be, for example, of linear or rotary type. Very generally, means for compressing the tubing is used to force fluid through the system, such as by way of rollers or any solid support that could be used to apply pressure to the tubing. Using rollers, for example, pressure is applied to the tubing by the rollers to cause the walls of the tubing to compress, otherwise referred to as occlusion. When compressed, the tubing pushes fluid forward through the system, i.e., the fluid is pumped or dispensed. As the pressure point is moved to cause additional flow to the fluid (the pressure point in this example being caused by the roller), the tubing not under compression by the roller re-establishes its natural state. As the resilient tubing returns to its natural state, fluid is imported into the system and then exported through the system as pressure is re-instated.

In a rotary-type system, the tubing is situated between rotor wheels, which comprise one or more rollers, and a support, which provides counter pressure to the tubing in response to pressure caused by the rollers. As the rotor wheels turn, the rollers of the rotor wheels individually come into contact with the tubing and then disengage the tubing, causing the tubing to be pinched and then released to its natural state. Successive pinching and releasing of the tubing causes fluid to pass through the system and, thus, be dispensed or pumped.

Peristaltic pumps have been designed for applications where it is desirable to pump or dispense multiple fluids, however, there still exists a need for an addressable multi-channel pump. Currently, no one pump is capable of selecting one or more fluids for dispensing. For example, to achieve multiple fluid dispensing capability with existing technology, a separate pump is operated to pump each fluid, which typically requires a separate motor for each pump. Further, for example, in existing single-motor multi-channel peristaltic pumps, there is no selectivity and the fluids of all channels are dispensed at the same time.

SUMMARY OF THE INVENTION

To address some of the inefficiencies inherent in existing multi-channel peristaltic pump designs, the present invention provides addressable multi-channel peristaltic pumps. The pump designs according to the invention allow for selection and operation of one or more pump heads on a drive shaft, while locking other non-selected pump heads in a stationary position. It is possible to operate the multi-channel pumps according to the invention using a limited number of motors, preferably two motors: a selector motor and a dispense motor. Thus, the pumps provide for pumping or dispensing of one or more fluids without the need for multiple dispense motors (one motor for each pump head) as is typically required by pump systems having multi-fluid dispense capabilities. Likewise, compared with typical single motor multi-channel systems, where all pump heads on the drive shaft must rotate at the same time, the present invention provides for selective dispensing of one or more fluids.

The pumps of the present invention are suitable for automated multi-channel reagent dispensing systems, such as nucleic acid and protein purification systems, or any multiple fluid transfer application. The pumps of the present invention are especially suitable, for example, in fluid transfer applications that would benefit from isolation of fluid from the system and other fluids. The pumps of the present invention could be incorporated into or used in conjunction with devices and systems for purification of substances (e.g., nucleic acid purification), including such systems as described in, for example, U.S. patent application Ser. No. 11/764,117 and corresponding International Patent Application No. PCT/US07/71402, entitled "System of Isolation of Biomolecules from a Sample," the disclosures of which are hereby incorporated by reference. The pumps of the present invention are suitable for any fluid transfer application, especially for pumping or moving fluids, including air and liquids, within and among the different functional components of systems for the purification of samples of interest.

One aspect of the present invention provides a peristaltic pump comprising multiple rotor wheels for pumping fluid through at least one flexible channel; a dual-shaft, concentric drive shaft for selecting and rotating at least one of the rotor wheels to pump fluid through at least one channel; and one or more motors for operating the concentric drive shaft. The drive shaft is a dual-shaft, concentric drive shaft, which comprises an inner drive shaft, which is interior to and concentric with an outer drive shaft. The pumps in accordance with the invention are addressable, meaning each pump is capable of selecting one or more channels of fluid for individual or concurrent (e.g., simultaneous) pumping of fluid contained in at least one of the channels. For example, the pumps in accordance with the present invention can address or select two fluid channels for simultaneous dispensing of reagent.

In embodiments of the invention, one motor can be used for operating the inner drive shaft in selecting the appropriate rotor wheels and a second motor can be used for operating the outer drive shaft in rotating the selected rotor wheels to pump fluid.

Additionally, in embodiments of the invention, the pumps may further comprise an alignment plate for preventing rotation of unselected rotor wheels. Additionally, the alignment plate serves to counter balance the tubing compression force exerted by the unselected rotor wheels, thus minimizing the radial load on the outer shaft. The alignment plate may also comprise an alignment plate notch for allowing rotation of selected rotor wheels.

In yet further embodiments, the pumps may be controlled by an electronic motor driver and a computing device.

In preferred embodiments, the pumps in accordance with the invention are capable of selecting and rotating one or more, and more preferably two, of the multiple rotor wheels to pump simultaneously one or more, and preferably two, fluids of a multi-channel pump.

Additionally, the present invention provides peristaltic pumps comprising means, such as a drive shaft, for selecting and pumping more than one and less than all fluids through multiple flexible channels. Preferably, means for selecting and pumping can be provided by a dual-shaft, concentric drive shaft comprising an inner shaft and an outer shaft. In preferred embodiments, the pumps comprise a first motor for operating the inner shaft and a second motor for operating the outer shaft.

Another aspect of the present invention includes a peristaltic pump comprising (a) multiple rotor wheels for pumping fluid through at least one flexible channel, each rotor wheel comprising an exterior surface and a substantially cylindrical interior surface, wherein each of those surfaces comprises an engagement notch; (b) a substantially cylindrical outer drive shaft concentric to the interior surface of the rotor wheels, wherein the outer drive shaft is substantially C-shaped, comprising a length-wise engagement notch; and (c) an inner drive shaft concentric to the interior surface of the outer drive shaft, wherein the inner drive shaft comprises structure for engagement (otherwise referred to as a "key") with the rotor wheels at the interior surface notch of the rotor wheels for rotor wheel selection, and the key provides for rotating the selected rotor wheels engaged by the key, which is engaged with the length-wise notch of the outer drive shaft. Additionally, the pump can further comprise an alignment plate to engage with the notch of the exterior surface of the unselected rotor wheels (for preventing rotation of rotor wheels not engaged by the key of the inner drive shaft) and the alignment plate can comprise a notch or cut out to allow rotation of the selected rotor wheels (rotor wheels engaged by the key of the inner drive shaft). Additionally, the alignment plate provides means to counter the radial load exerted by the unselected rotor wheels.

In preferred embodiments, the pumps comprise a first motor for selecting fluid by laterally positioning the key of the inner drive shaft to engage with at least one rotor wheel at the notch of the rotor wheel's interior surface, and comprise a second motor for pumping fluid by rotating the outer drive shaft, which rotates the key (because the key is engaged by the length-wise notch of the outer drive shaft), which rotates the selected rotor wheels (rotor wheels engaged by the key).

In yet other embodiments, flexible channels for pumping fluids can comprise single-piece extruded tubing capable of engaging and disengaging with said pump. Such modular tubing, which may also be disposable, allows for isolation of fluid from the pump, which reduces or eliminates contamination, cleaning, and/or maintenance of the pump.

The invention further provides for a system for purifying a substance of interest (such as nucleic acid purification) comprising (a) a reagent pack or receptacle for storing fluids for movement through the system; (b) a purification unit or cartridge for purifying a substance of interest; and (c) a peristaltic pump comprising (1) multiple rotor wheels for pumping fluid through at least one flexible channel; (2) a dual-shaft, concentric drive shaft for selecting and rotating at least one rotor wheel to pump the fluid through at least one channel; and (3) one or more motors for operating the concentric drive shaft. Such systems in accordance with the present invention can comprise or be configured to engage with flexible channels or tubing for transporting fluid. Preferably, such tubing is modular and/or disposable in nature and comprises single-piece extruded tubing capable of engaging and disengaging with the pump.

Methods of pumping fluids using peristaltic pressure are also provided by the present invention, including a method of pumping fluid comprising operating a dual-shaft, concentric drive shaft to select and rotate at least one of multiple rotor wheels for pumping fluid through at least one flexible channel. Such methods may be controlled by a computing device.

Advantages provided by embodiments of the methods, systems, and pumps of the present invention include advantages gained by combining a multi-channel function of a pump in small package with, preferably, only two motors. In preferred embodiments, the pumps of the present invention use two motors to select and dispense multiple reagents, whereas as is typical of existing systems comprising multiple pumps, a separate motor dedicated to each pump dispenses each fluid. The pumps of the invention can be configured to be of any size appropriate for a particular fluid transfer application. In the following embodiments, a compact pump (approximately the size of a shoe box) is described, which is especially suitable for transporting or pumping relatively small volumes of fluids, such as is typically desirable in nucleic acid and protein purification applications.

BRIEF DESCRIPTION OF THE DRAWINGS

The accompanying drawings, which are incorporated in and constitute a part of this specification, illustrate several embodiments of the invention. Together with the written description, these representative embodiments serve to explain certain principles or details of various aspects of the present invention.

DETAILED DESCRIPTION OF VARIOUS EMBODIMENTS OF THE INVENTION

Reference will now be made in detail to various exemplary embodiments of the invention, examples of which may also be illustrated in the accompanying drawings. The following detailed description is provided to give the reader a better understanding of certain features and details of embodiments of the invention, and is not to be understood as a limitation on any aspect or feature of the invention as broadly disclosed herein, depicted in the figures, or claimed. It will be readily apparent to those of skill in the art that various other modifications to the present invention may be made without departing from the scope and spirit of the invention.

Figure 1:
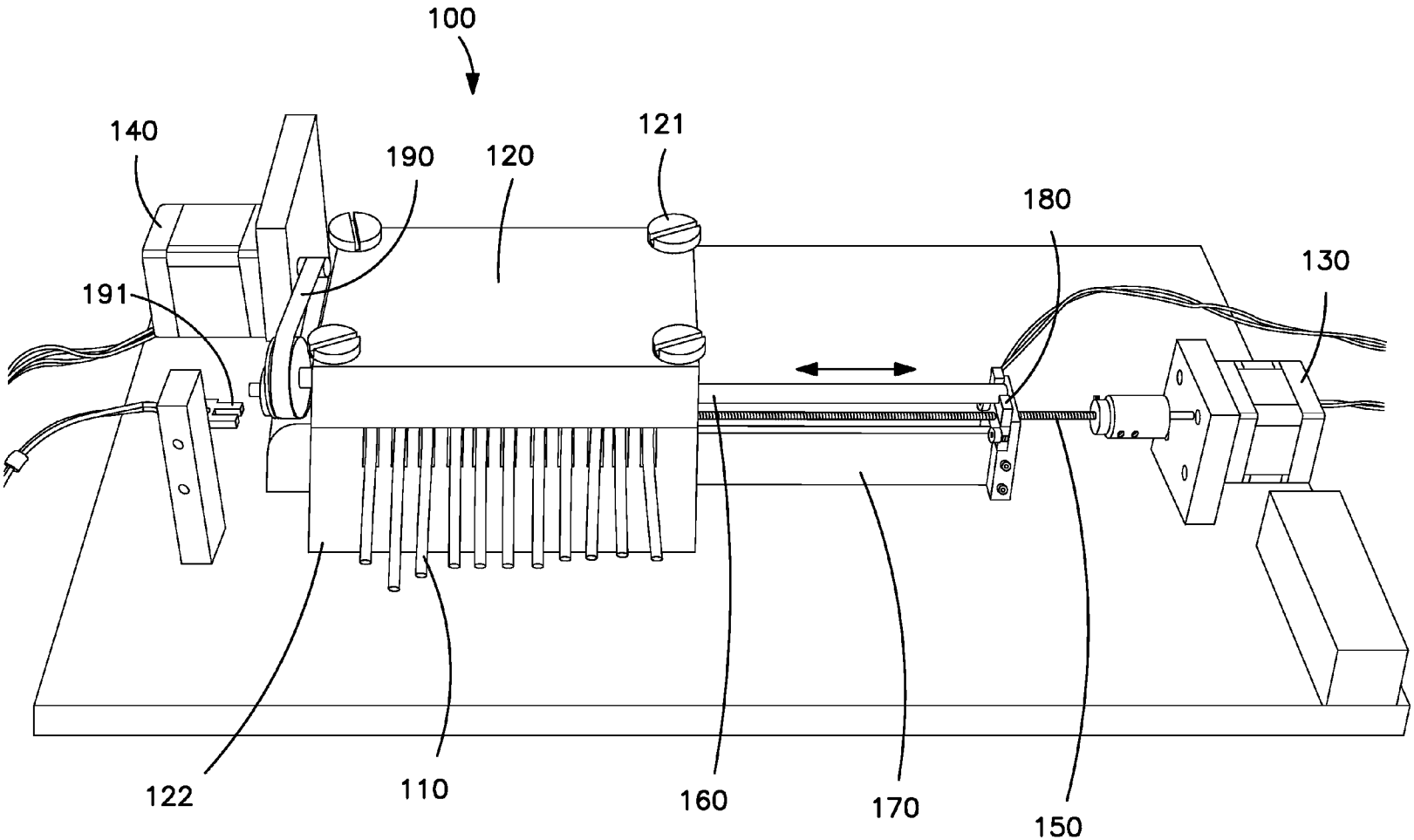
FIG. 1 shows a perspective view of a multi-channel peristaltic pump according to one embodiment of the invention, in particular, a front/top view of a representative 11-channel pump.

An exemplary embodiment of a multi-channel peristaltic pump (100) according to the invention is provided in FIG. 1. This embodiment shows an 11-channel pump, although any number of channels can be incorporated into the pump according to the invention. The terms "multi" and "multiple" as used in the context of this invention refer to more than one. The 11-channel pump according to this embodiment can accommodate tubing for up to eleven fluids or reagents. In the context of this invention, it is further understood that the terms fluid and reagent may be used interchangeably. Any substance capable of flowing is a fluid according to this invention, e.g., any substance whose molecules move freely past one another or any substance that tends to conform to the shape of its container. Fluids and fluid combinations that can be used in accordance with this invention include, for example, any liquid or gas. It is further understood that any of the channels can be used for the same or different fluids or reagents.

In this embodiment, exemplary tubing (110) is shown. Tubing (110) is located under or incorporated into pressure housing (120). Pressure housing (120) can be secured in the assembly by any appropriate securing means. In this embodiment, pressure housing (120) is secured by way of four screws (121) to pressure housing support (122). In other embodiments, pressure housing (120) may be secured by its weight alone or, for example, the weight of a reagent pack placed on tubing may cause sufficient pressure for the system without the need for additional securing means. In any of the embodiments of this invention, pressure housing (120) and/or tubing (110) can be incorporated as part of a reagent pack, as part of the pump, or can be a separate component of the system. Advantageously, tubing (110) is a separate component of the system and is disposable. In such an embodiment, tubing (110) allows for pumping and dispensing of reagents without fluids coming into contact with the internal workings of the pump, thus, eliminating cleaning of the pump due to a possible build up of reagents in the system over time. If a disposable reagent pack is used, disposable tubing may be incorporated into the reagent pack as well. In a preferred embodiment, tubing (110) is configured so as to comprise a single-piece extruded tubing with multiple channels, which has means for communicating with a reagent pack and purification system, and can be used with a pump without contamination to the pump. In embodiments, tubing (110) can be secured to pressure housing (120) or a reagent pack. In particular, structure incorporated into tubing (110) and corresponding structure incorporated into pressure housing (120) or the reagent pack, such as a tongue and groove configuration, may be used. Additionally, tubing (110) may be secured to the interior of pressure housing (120) by way of adhesive.

In this embodiment, pump (100) is operated by two motors: a reagent selector motor (130) and a reagent dispense motor (140). In general, the pumps of the invention can be operated or controlled by a computing device. Typically, the computing device will comprise computer software (e.g., a computer program) that executes on a computing device to implement one or more steps in the pumping process. The means for controlling typically comprises software that, when executed by a computing device by way of an electronic motor driver, results in control of one or more mechanical devices of the system, including operation of reagent selector motor (130) and/or reagent dispense motor (140), which in turn operate the inner and outer drive shafts. The computing means can comprise commercially available hardware and software, and can use any of a number of standard components, computer languages, and the like. Reagent selector motor (130) provides means for selecting reagents to be dispensed. In this embodiment, reagent selector motor (130) cooperates with a linear actuator to convert rotational movement generated by the reagent selector motor (130) to linear movement of the reagent selector mechanism. In this embodiment, lead screw (150), in combination with other components including a linear actuator and motor, provides means for moving the inner shaft with key (160), the alignment plate (170), and corresponding support (180) in a linear path, as shown by the double-headed arrow. The inner shaft with key (160) and the alignment plate (170) cooperatively assist with reagent selection. Reagent dispense motor (140) operates belt drive (190), which provides means for pumping or dispensing the fluids. Belt drive (190) by way of timing gears modifies the torque provided by motor (140) to the drive shaft to provide the appropriate torque needed for the drive shaft. One or more sensors, for example sensor (191), can be incorporated into the system to provide means for determining the position of the drive shafts. In this embodiment, sensor (191) cooperates with structure incorporated into belt drive (190) for determining outer drive shaft position. To select reagents for dispensing, the outer drive shaft must be homed, or in position to facilitate engagement of the inner drive shaft and key with the rotor wheels.

Figure 2:
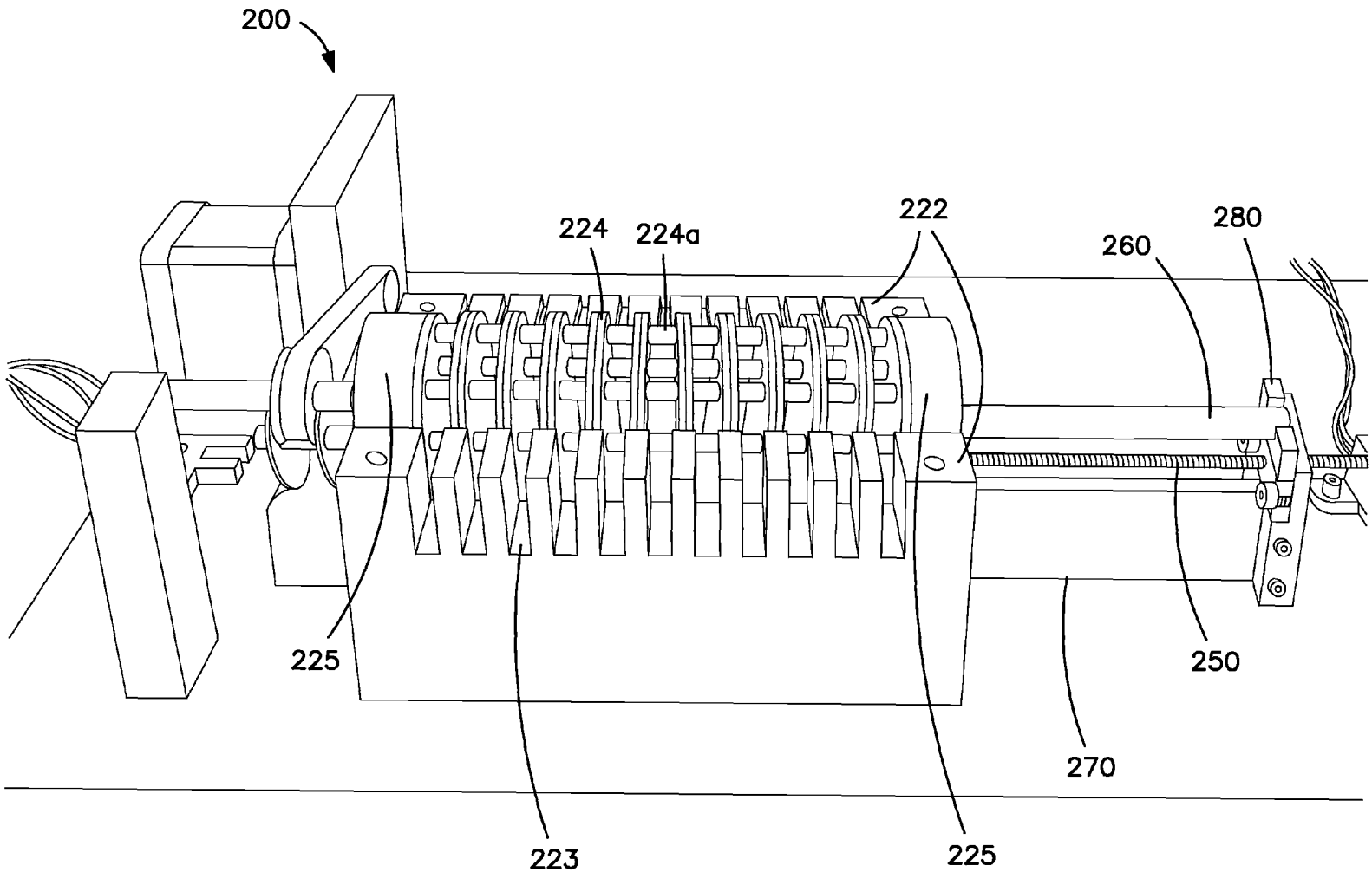
FIG. 2 shows a front/top view of a representative pump according to the invention, showing an internal perspective of the pump.

FIG. 2 shows a front/top view of pump (200), which corresponds with pump (100) of FIG. 1, however, pressure housing (120) and tubing (110) as depicted in FIG.1 have been removed to show a more internal perspective of pump (200).

Pressure housing supports (222) are located at the front and back of the pump. In this embodiment, in addition to providing support to the pressure housing, pressure housing supports (222) additionally provide channels (223) for guidance and support of the tubing. Also revealed in FIG. 2 are rotor wheels (224). Although any number of rotor wheels (224) can be incorporated into the pumps according to the invention, in this embodiment eleven rotor wheels (224) are exemplified. Rotor wheels (224) comprise rollers (224*a*), which when rotated in conjunction with rotor wheels (224) assert and release pressure on the tubing to cause fluid to move within the tubing, i.e., peristaltic pressure. Although rotor wheels (224) may comprise any number of rollers (224*a*), advantages in certain applications may be realized by having a number of roller wheels (224) that allows for at least two rollers (224*a*) of one rotor wheel (224) to be in concurrent contact with tubing. Decreasing the number of rollers (224*a*) on a rotor wheel (224) leads to increased pulsation of fluid flow on output and increases the depth required of tubing wrapped around the rotor wheels (224). On either end (right and left) of rotor wheels (224) are drive shaft supports (225). In addition to supporting the outer shaft of the drive shaft, supports (225) also provide guidance or support for lead screw (250), inner shaft (260), and alignment plate (270), which are also supported further to the right by support (280).

Figure 3:
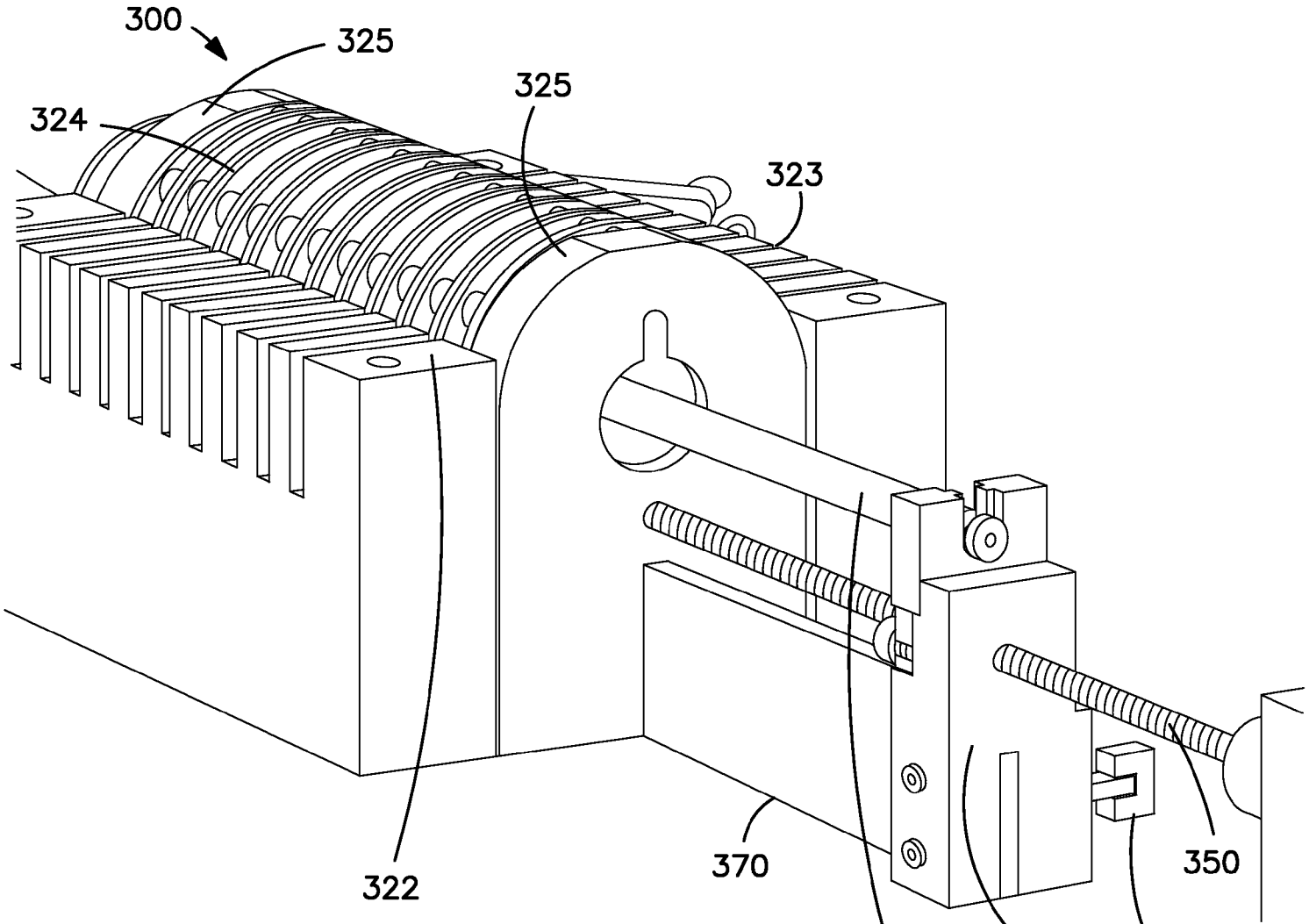
FIG. 3 is a front/top/right side view of a representative pump according to the invention, showing an internal perspective of the pump.

FIG. 3 shows a top/front/right side view of pump (300), which corresponds with pump (200), as shown in FIG. 2. Pump (300) shows pressure housing supports (322), tubing channels (323), rotor wheels (324), drive shaft supports (325), lead screw (350), inner drive shaft (360), alignment plate (370), and support (380). Also shown in FIG. 3 is sensor (381), which provides means for determining the position of the inner shaft and key relative to the rotor wheels. Sensor (381) determines the home position of support (380), as structure incorporated into support (380) passes through sensor (381).

Figure 4:
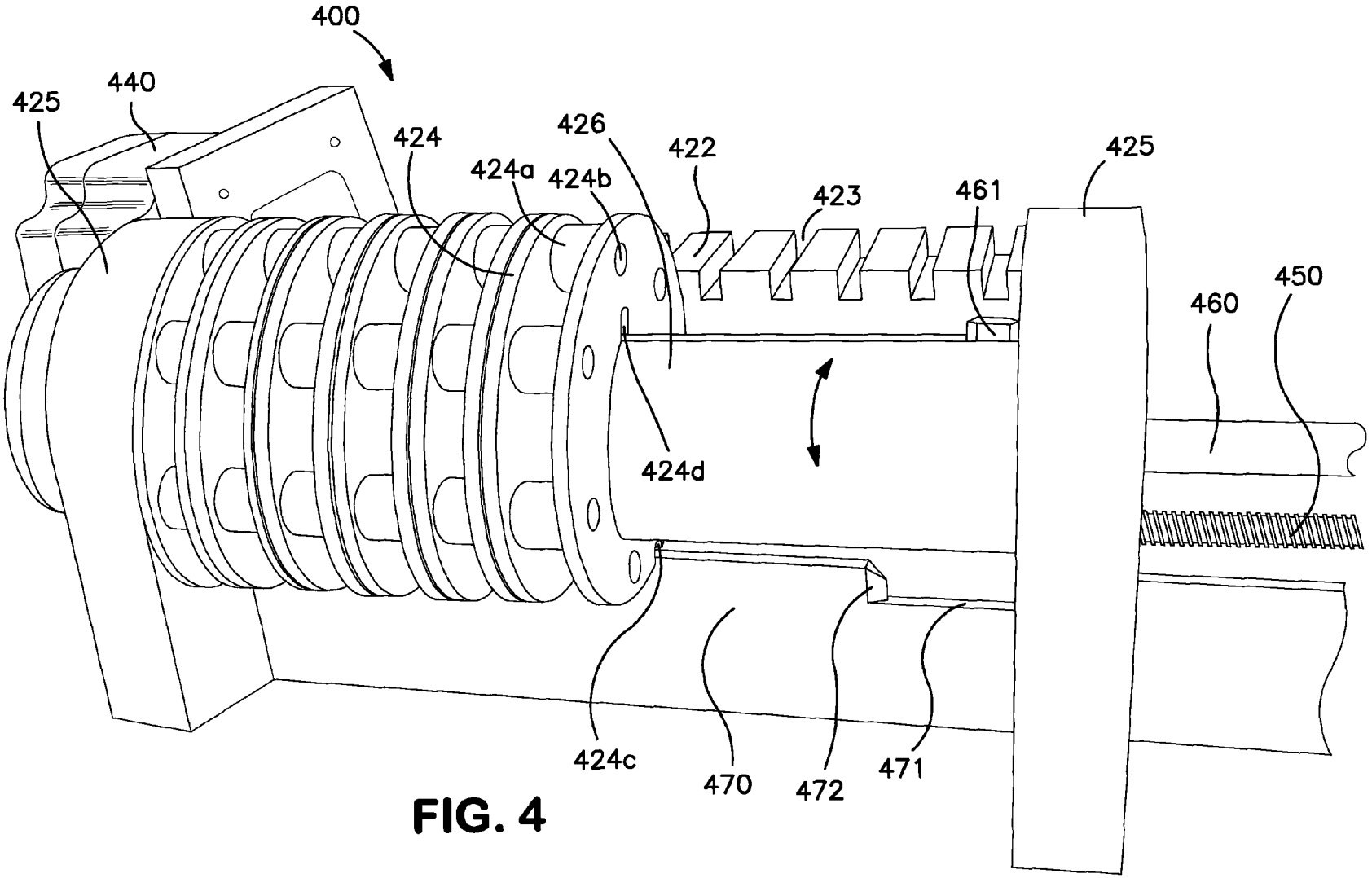
FIG. 4 shows a front/top view of a representative pump according to the invention, providing an internal view of the pump and showing the reagent selector key and alignment plate in position for selecting a rotor wheel in the first position.

FIG. 4 shows the front/top view of pump (400), which corresponds with pump (100) of FIG. 1 without pressure housing (120), tubing (110), and front pressure housing support (122). Further, FIG. 4 also corresponds with pump (200) of FIG. 2 without five of the eleven rotor wheels (224). As revealed in FIG. 4, pump (400) shows a pressure housing support (422) on the back side of pump (400). The main drive shaft, also referred to as outer shaft (426) is supported on opposite ends (right and left) by drive shaft supports (425). Drive shaft supports (425) support outer drive shaft (426) in such a way as to allow for unimpeded rotation of outer drive shaft (426) during dispensing of reagents.

In the embodiment shown by FIG. 4, although configured to accommodate eleven rotor wheels (424), outer drive shaft (426) shows the accommodation of only six rotor wheels (424), specifically, rotor wheels (424) in positions 6 to 11. Rotor wheels (424) in positions 1 to 5 have been removed for purposes of this figure to show how the inner shaft (460), key (461), alignment plate (470), and alignment plate cut out (471) may be positioned by lead screw (450) for selecting desired rotor wheel(s) (424).

For example, lead screw (450), which is powered by the reagent selector motor, provides means for moving and positioning the inner shaft (460), key (461), alignment plate (470), and alignment plate cut out (471) in the appropriate position for selecting certain reagent(s). As shown in FIG. 4, inner shaft (460) and key (461) are positioned to select a rotor wheel (424) that would be in the first position (if actually present on the drive shaft). In this position, key (461) is positioned in front of first tubing channel (423). Additionally, alignment plate (470) is positioned to allow for selection of rotor wheel (424) in the first position by having alignment plate cut out (471) positioned below key (461). Alignment plate cut out (471) allows for the selected rotor wheels (424) to turn (as shown by the double-headed arrow) with the outer drive shaft (426) and key (461) when powered by the dispense motor (440). Outer drive shaft (426) and inner drive shaft (460) are concentric shafts, meaning inner drive shaft (460) is situated within outer drive shaft (426). Both inner drive shaft (460) and outer drive shaft (426) are substantially cylindrical and in this embodiment the cylinders are rounded, however, any geometry could be used, such as for example square, rectangular, or triangular, etc. The shape of certain rods, cylinders, etc. as described herein is not critical so long as the appropriate function provided by a particular component is achieved. Such a dual-shaft configuration provides for selection of reagents by moving inner drive shaft (460) laterally within outer drive shaft (426), while key (461) moves laterally through an opening along the length of outer drive shaft (426). Once key (461) is positioned relative to and engaged with appropriate selected rotor wheels (424), outer drive shaft (426) rotates, carrying key (461) with it, which in turn rotates engaged rotor wheel (424).

Additionally, rotor wheels (424) comprise key notch (424*d*) for communication with key (461), which in combination with outer drive shaft (426) provide means for rotating rotor wheel (424). With key (461) in the first position, a rotor wheel (424) in the first position would be engaged for dispensing reagents by way of communicating key (461) with key notch (424*d*). Such actual engagement is not shown in FIG. 4, however, as the rotor wheel of the first position has been removed. Simultaneously, unselected rotor wheels (424) are locked into position by communication of alignment plate (470) with alignment plate notch (424*c*) of rotor wheel (424). In this embodiment, rotor wheels (424) of positions 2-11 would be locked by communication of alignment plate (470) with alignment plate notch (424*c*). More specifically, rotor wheels (424) in positions 3-11 would be locked by alignment plate (470) and rotor wheel (424) in position 2 would be locked by edge (472) of alignment plate (470). The "locked" rotor wheels (424), thus, will not rotate with outer shaft (426) upon dispensing fluids corresponding to the "unlocked" or selected channels. Rotor wheel(s) (424) that are selected with key (461) provide means for peristaltic pumping or dispensing of desired fluids by way of rollers (424*a*) secured by dowels (424*b*) to rotor wheels (424).

Figure 5:
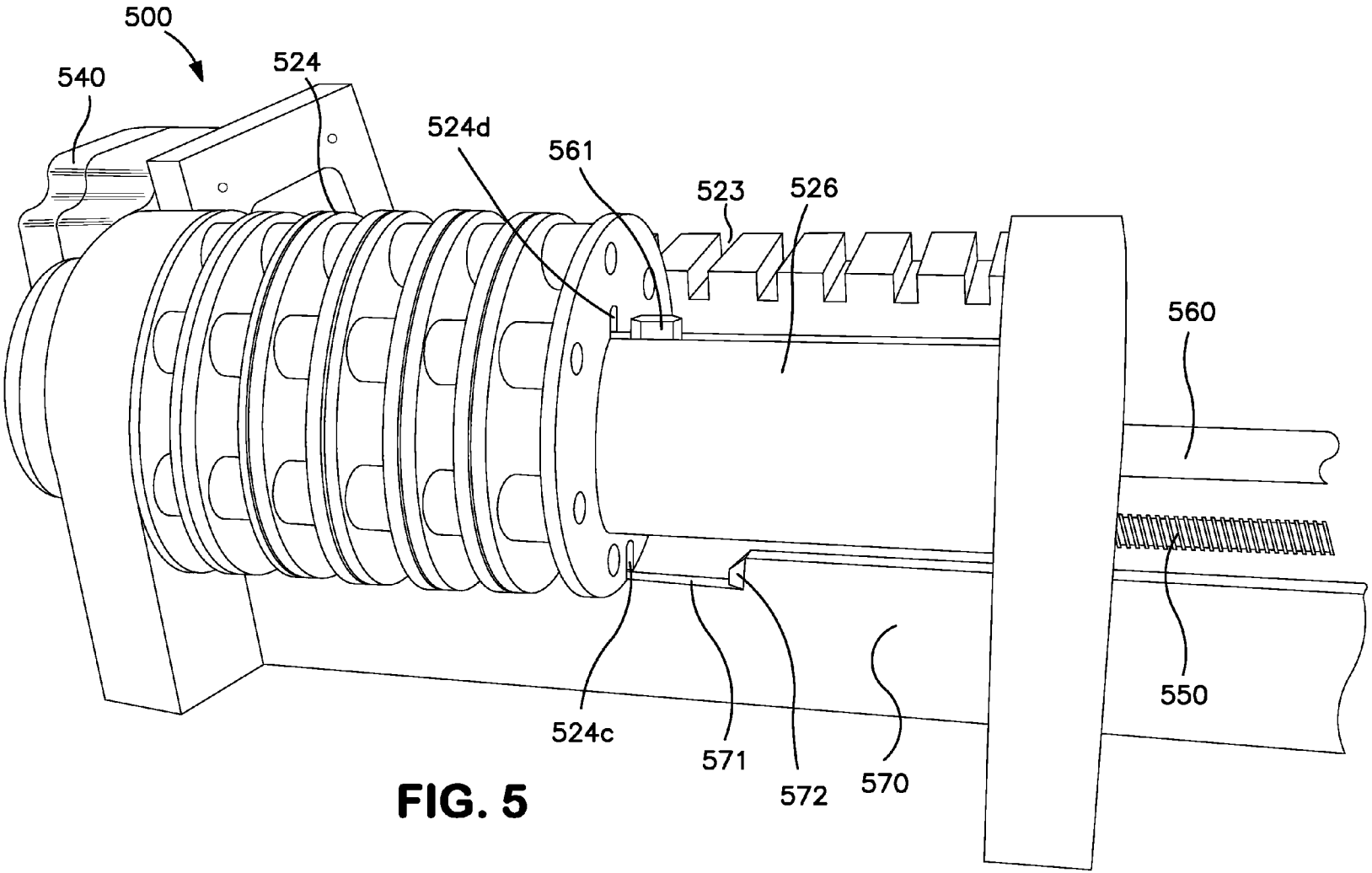
FIG. 5 shows front/top view of a representative pump according to the invention, providing an internal view of the pump and showing the reagent selector key and alignment plate in position for selecting a rotor wheel in the fifth position.

FIG. 5 shows pump (500), which corresponds with pump (400) of FIG. 4, however, in this configuration inner shaft (560), key (561), alignment plate (570), and alignment plate cut out (571) are positioned for selection of a rotor wheel (524) that would be in the fifth position on outer drive shaft (526). In this embodiment, lead screw (550) provides means for selecting reagents by inducing lateral movement of inner shaft (560), key (561), alignment plate (570), and alignment plate cut out (571) for communication with rotor wheels (524).

As shown, key (561) is positioned in front of the fifth tubing channel (523). For purposes of this figure, rotor wheel (524) of the fifth position has been removed from outer drive shaft (526) to show positioning of key (561), which would communicate with and engage rotor wheel (524) of the fifth position. Rotor wheels (524) communicate with key (561) by way of key notch (524*d*). As shown further, alignment plate cut out (571) is positioned below key (561) to allow for rotation of the selected rotor wheel (524) of the fifth position. The selected rotor wheel (524) will rotate with outer drive shaft (526) and key (561), when powered by dispense motor (540). With alignment plate cut out (571) positioned below key (561) in the fifth position, rotor wheel (524) in the fifth position is allowed to rotate while all other rotor wheels (524) are prevented from rotating. Rotor wheels (524) are prevented from rotating by communicating alignment plate notch (524*c*) of each of rotor wheels (524) in positions 1-3 and 6-11 with alignment plate (570). Rotor wheel (524) in the fourth position would be engaged with edge (572) of alignment plate (570) and thus also prevented from rotating. To rotate and dispense reagent corresponding to the fifth fluid channel, rotor wheel (524) in the fifth position is engaged by key (561) and allowed to rotate by being in communication with alignment plate cut out (571), while all other rotor wheels (524) are prevented from rotating.

Figure 6:
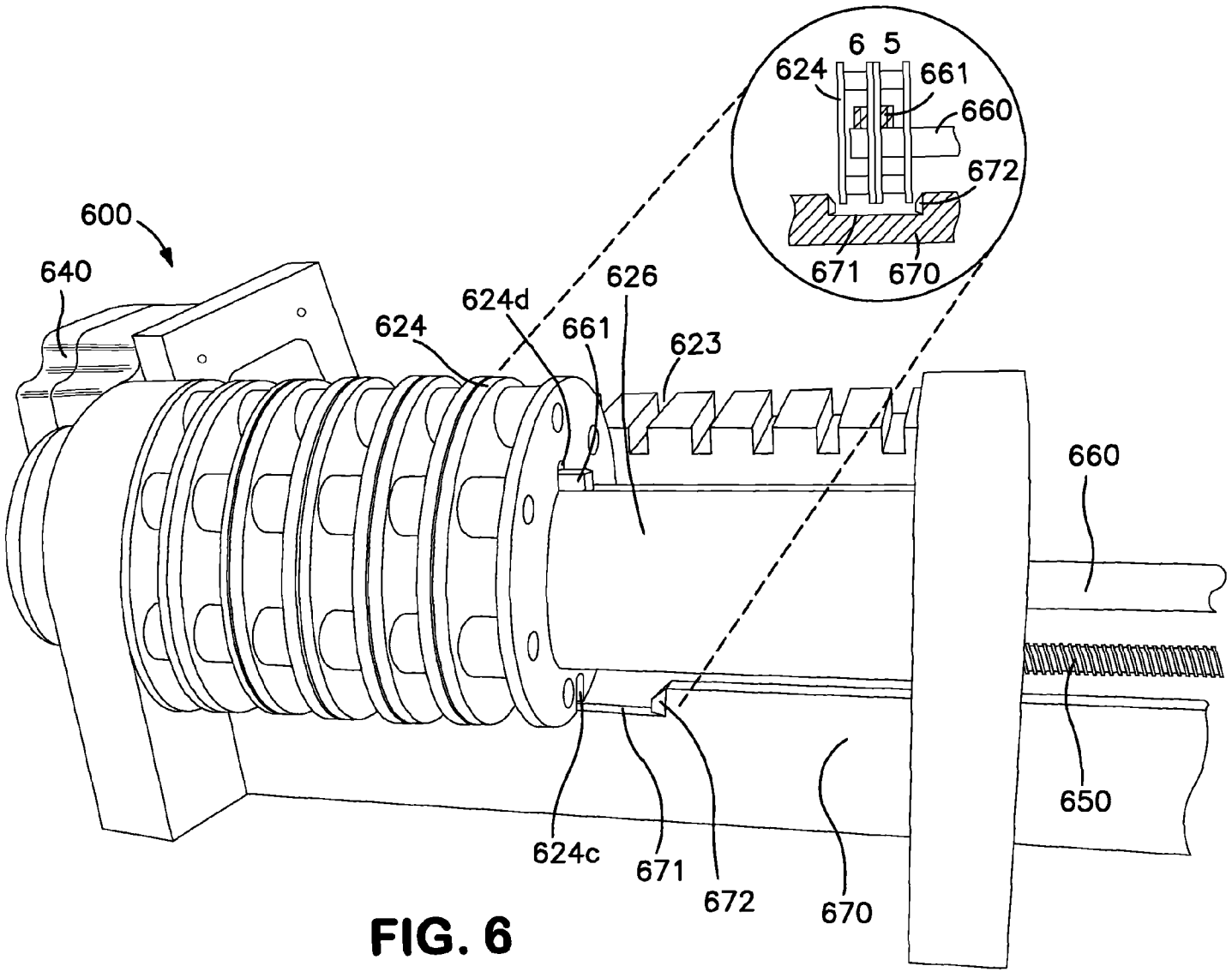
FIG. 6 shows front/top view of a representative pump according to the invention, providing an internal view of the pump and showing the reagent selector key and alignment plate in position for selecting rotor wheels in the fifth and sixth positions.

FIG. 6 shows pump (600), which corresponds with pump (500) of FIG. 5, however, in this configuration inner shaft (660), key (661), alignment plate (670), and alignment plate cut out (671) are positioned for selection of two rotor wheels (624), specifically rotor wheels (624) in both the fifth and sixth positions on outer drive shaft (626). As shown, key (661) is in communication with key notch (624*d*) of the rotor wheel (624) in the sixth position and (if actually present) would also be in communication with key notch (624*d*) of the rotor wheel (624) in the fifth position. Rotor wheel (624) of the fifth position has been removed in this figure for purposes of showing placement of key (661). In this embodiment, lead screw (650) provides means for selecting reagents by inducing lateral movement of inner shaft (660), key (661), alignment plate (670), and alignment plate cut out (671) for communication with rotor wheels (624).

As shown, key (661) is positioned to communicate with key notch (624*d*) of both rotor wheels (624) in the fifth and sixth positions. Key (661) is, thus, positioned between tubing channels (623) also in the fifth and sixth positions. When powered by dispense motor (640), outer drive shaft (626) in combination with key (661) provides for dispensing of fluids controlled by the selected rotor wheels (624) in the fifth and sixth positions. Additionally, alignment plate cut out (671) is positioned below both the rotor wheels (624) in the fifth and sixth positions to allow for rotation of those rotor wheels (624) with outer drive shaft (626) and key (661). As shown in the inset of FIG. 6, to allow for two rotor wheels (624) to rotate concurrently, the width of alignment plate cut out (671) should be slightly larger than the width of the two rotor wheels (624), so that neither is engaged or locked by alignment plate (670) or edge (672). Meanwhile, remaining rotor wheels (624) in positions 1-4 and 7-11 would not rotate because their alignment plate notch (624*c*), while in communication with alignment plate (670), would lock the remaining unselected rotor wheels (624) in place and prevent them from rotating.

Figure 7:
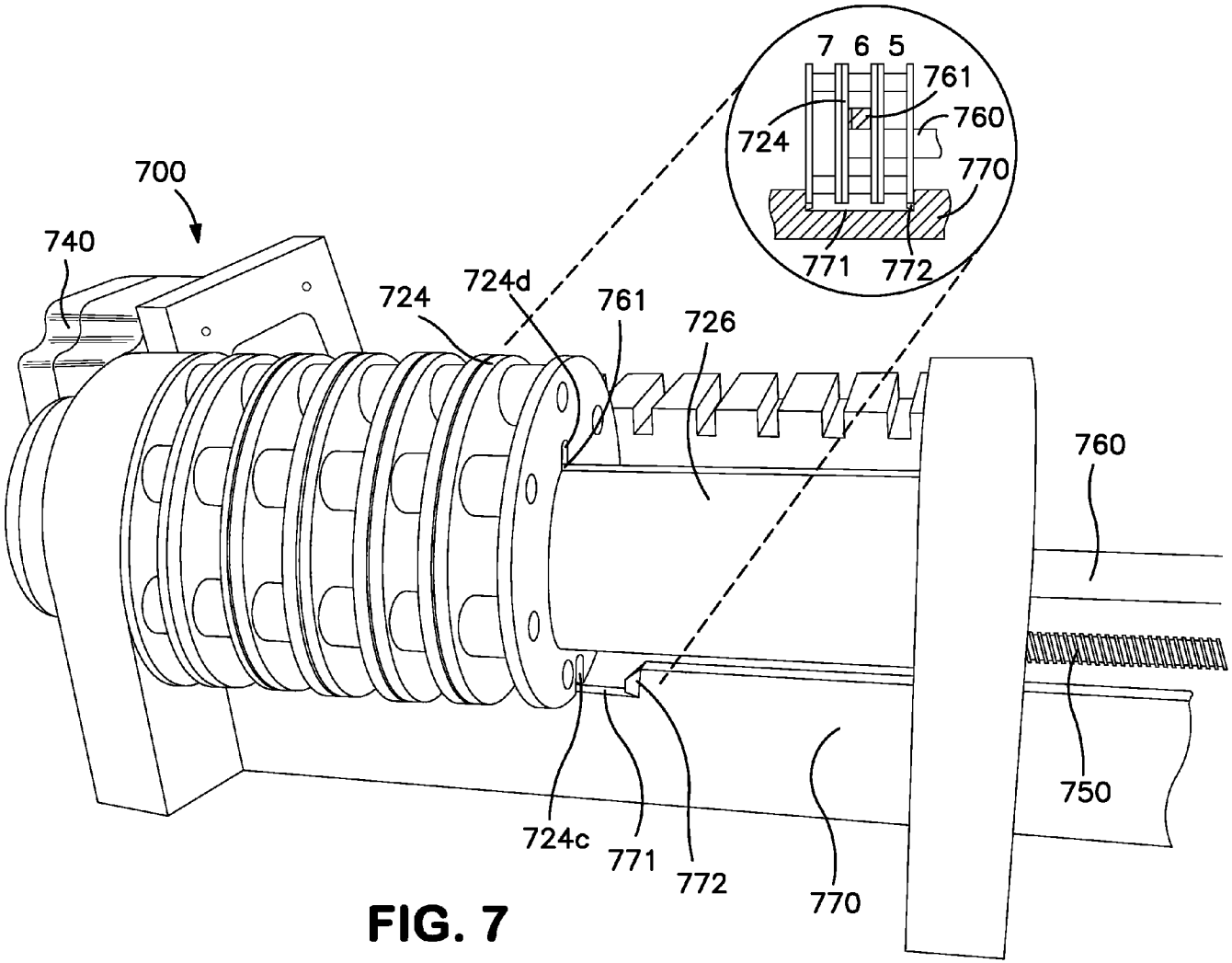
FIG. 7 shows front/top view of a representative pump according to the invention, providing an internal view of the pump and showing the reagent selector key and alignment plate in position for selecting the rotor wheel in the sixth position.

FIG. 7 shows pump (700), which corresponds with pump (600) of FIG. 6, however, in this configuration inner shaft (760), key (761), alignment plate (770), and alignment plate cut out (771) are positioned for selection of the rotor wheel (724) that is in the sixth position. Lead screw (750), when powered by the reagent selector motor, provides lateral movement for positioning inner shaft (760), key (761), alignment plate (770), and alignment plate cut out (771). As shown, key (761) is consumed and engaged in key notch (724*d*) of rotor wheel (724) in the sixth position. Key (761), in communication with key notch (724*d*) and in combination with outer drive shaft (726), provides means for dispensing the fluid controlled by the rotor wheel (724) in the sixth position. When outer drive shaft (726) is powered by dispense motor (740), in this embodiment, only rotor wheel (724) in the sixth position rotates, while rotor wheels (724) in positions 1-4 and 7-11 are held in position by alignment plate (770) in communication with alignment plate notch (724*c*). As shown in the inset of FIG. 7, rotor wheel (724) in the fifth position is engaged by edge (772) and, thus, also prevented from rotating. By communicating rotor wheel (724) of the sixth position with alignment plate cut out (771), this selected rotor wheel is not prevented from rotating with outer drive shaft (726), inner drive shaft (760), and key (761), when rotated by dispense motor (740). Accordingly, in this situation, only the reagent corresponding with fluid channel 6 is dispensed.

Figure 8:
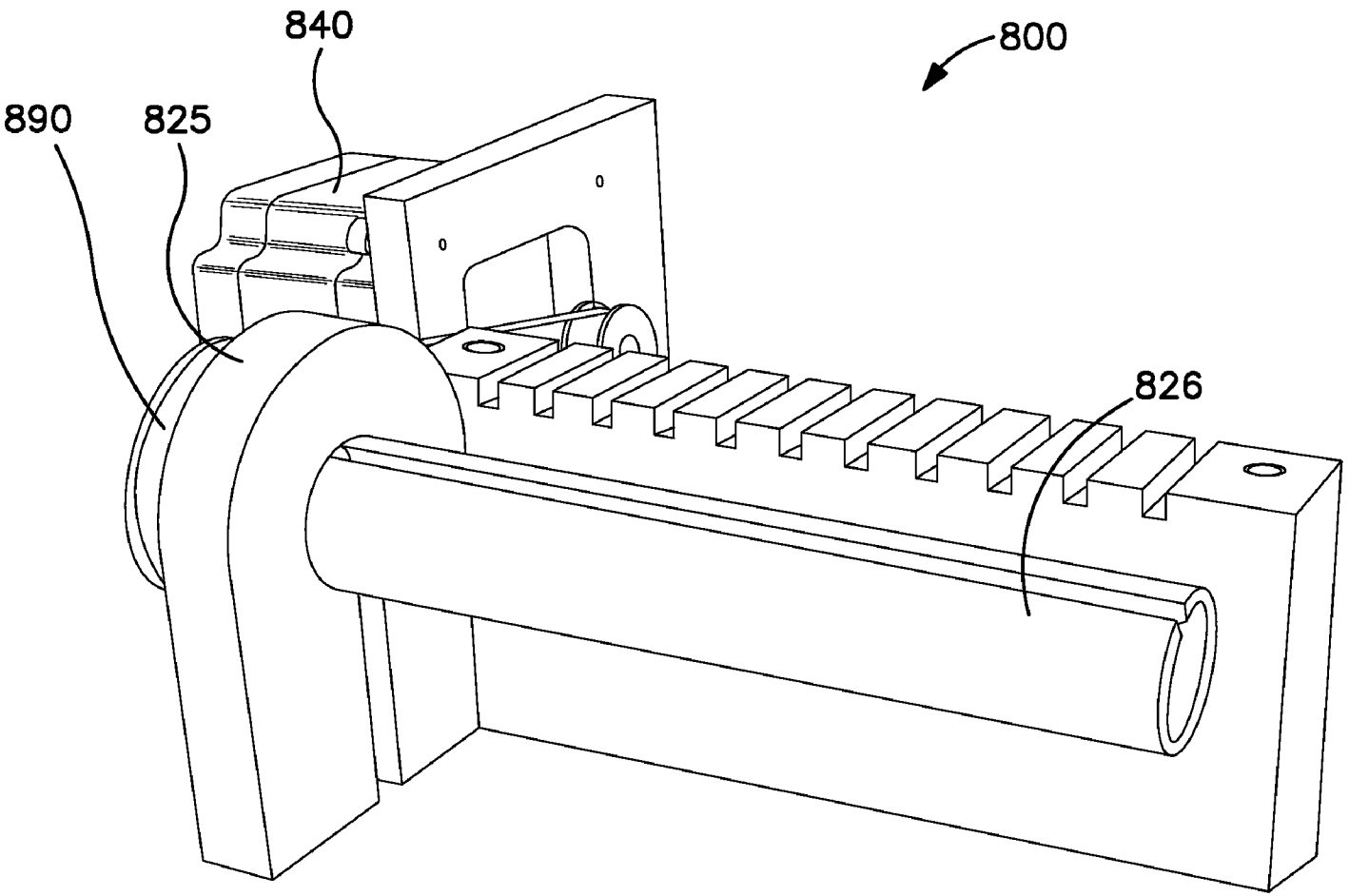
FIG. 8 shows an internal left-side view of a representative pump according to the invention, in particular, a representative main/outer shaft of the drive shaft assembly.

FIG. 8 shows an internal left-side view of pump (800). As shown, dispense motor (840) operates belt drive (890) to turn outer shaft (826). Although depicted in the figures as a belt-driven mechanism, any mechanism for coupling motor output to rotational energy of one or more shafts, rods, etc. is envisioned by the invention. Outer shaft (826) is supported by support (825). Support (825) allows for unimpeded rotation of outer drive shaft (826). In this embodiment, outer shaft (826) is substantially cylindrical and comprises a slot for key travel, thus, outer shaft (826) is substantially C-shaped to accommodate and communicate with the inner shaft and key as shown in the embodiments described above.

Figure 9:
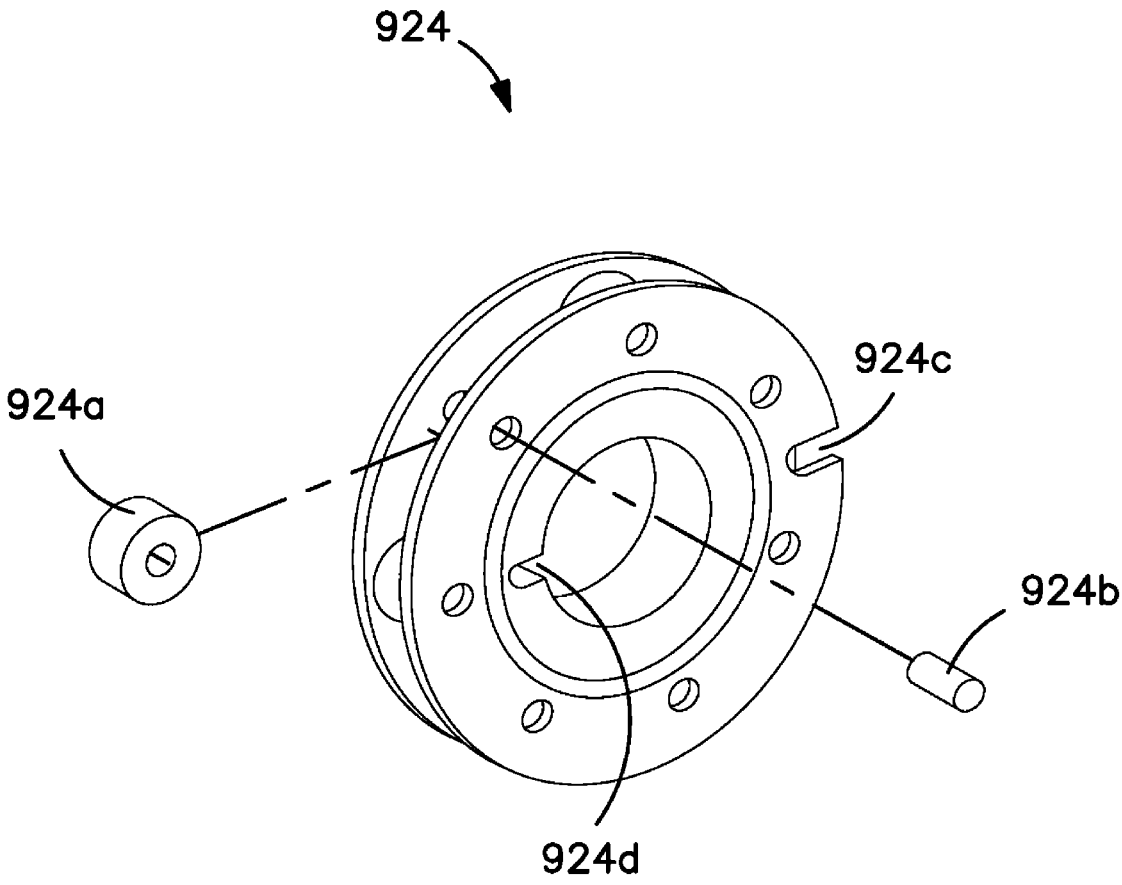
FIG. 9 shows a representative rotor wheel according to one embodiment of the invention, in particular, a rotor wheel comprising seven (7) rollers.

FIG. 9 shows a representative rotor wheel (924) for a rotary-type peristaltic pump in accordance with the invention. In this embodiment, rotor wheel (924) comprises seven rollers (924*a*), but any number of rollers can be used. Flexible tubing is placed so as to come into contact with rollers (924*a*). In select embodiments according to the invention, rotor wheels (924) comprise a number of rollers (924*a*) that allows for at least two rollers (924*a*) to concurrently contact the tubing at some point during operation of the pump. Although rotor wheels (924) can comprise any number of rollers (924*a*), having few rollers (924*a*) causes increased pulsation of fluid flow during dispensing of the fluid and increases the depth required of the tubing wrapped around rotor wheels (924). In embodiments, it is advantageous to have a shallow depth required of the tubing (e.g., a depth which corresponds with tubing wrapped around rotor wheels (924) at less than 180 degrees), including that it is easier to engage such tubing with the pump and that it is easier to manufacture such a tubing assembly. Rollers (924*a*) cause movement (by peristaltic means) of fluid contained in the tubing, when rotor wheels (924) are rotated. As rollers (924*a*) come into contact with resilient tubing, the tubing is compressed, which in turn asserts pressure on the fluid contained in the tubing. This pressure causes the fluid to flow within the tubing. As roller (924*a*) is rotated with rotation of rotor wheel (924), roller (924*a*) is released from contacting the tubing. The decompressed tubing then returns to its natural shape, which causes further pressure to be exerted on the fluid, thus, drawing more fluid into the system through the tubing. Rotor wheels (924) further comprise dowels (924*b*), which are used in this embodiment to secure rollers (924*a*) to rotor wheel (924), but any means for securing the rollers can be used. Roller wheel (924) further comprises alignment plate notch (924*c*) for communication with the alignment plate to prevent roller wheel (924) from rotating, if so desired. The shape or size of alignment plate notch (924*c*) is not critical, as long as it facilitates communication with the alignment plate for fixing unselected roller wheels (924) in place. Roller wheel (924) further comprises key notch (924*d*) for communication with the key, which together with the inner and outer drive shafts provide means for rotating a selected rotor wheel, when desired.

Figure 10:
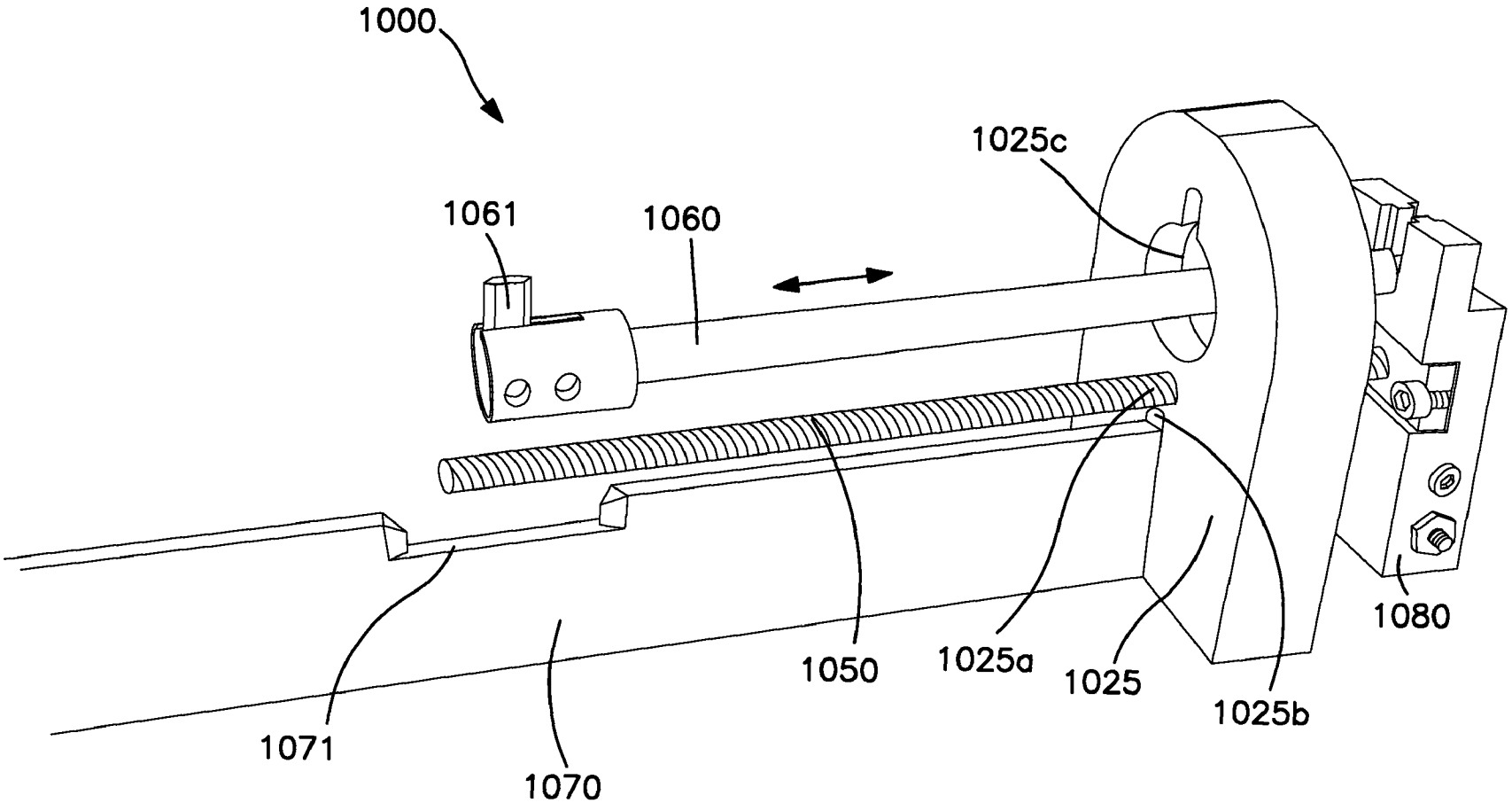
FIG. 10 shows an internal right-side view of a representative pump according to the invention, in particular, representative inner shaft (with key), lead screw, alignment plate, and support for inner shaft, lead screw, and alignment plate.

FIG. 10 shows an internal right-side view of pump (1000) in accordance with the invention. During reagent selection, inner drive shaft (1060) moves laterally (as shown by the double-headed arrow) through opening (1025*c*) and within the outer drive shaft, which is supported by opening (1025*c*). Lead screw (1050) is supported by and rotates within opening (1025*a*) of support (1025), and alignment plate (1070) moves laterally through opening (1025*b*). At the right end of the pump, support (1080) further supports lead screw (1050), inner shaft (1060), and alignment plate (1070). During reagent selection, support (1080) also moves laterally (in direction shown by double-headed arrow) with inner shaft (1060) and alignment plate (1070), as lead screw (1050) rotates in response to power provided by the reagent selector motor. Inner shaft (1060), key (1061), alignment plate (1070), and alignment plate cut out (1071) are positioned to select the appropriate rotor wheel(s) needed for dispensing particular reagents. During reagent dispensing, inner drive shaft (1060) rotates with the outer drive shaft and within opening (1025*c*) of support (1025). Outer drive shaft support (1025) provides support to the outer drive shaft but also allows for rotation of the outer drive shaft during reagent dispensing.

Figure 11A:
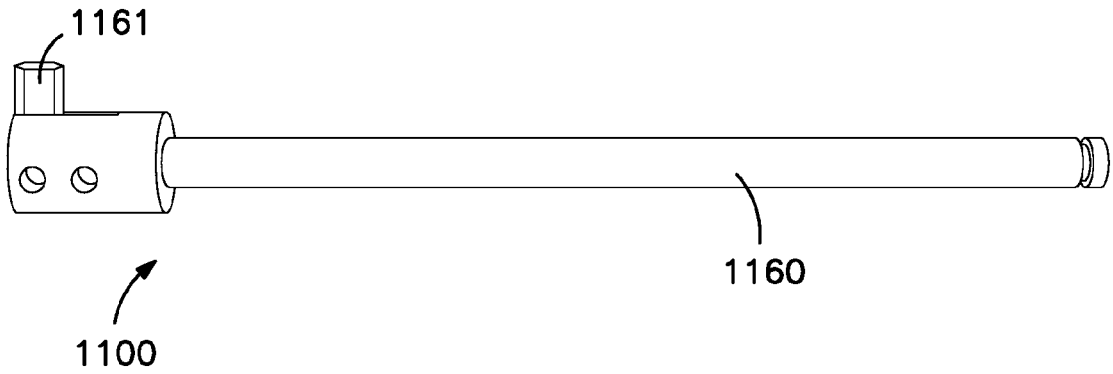
FIG. 11A shows a representative inner drive shaft with key.
Figure 11B:
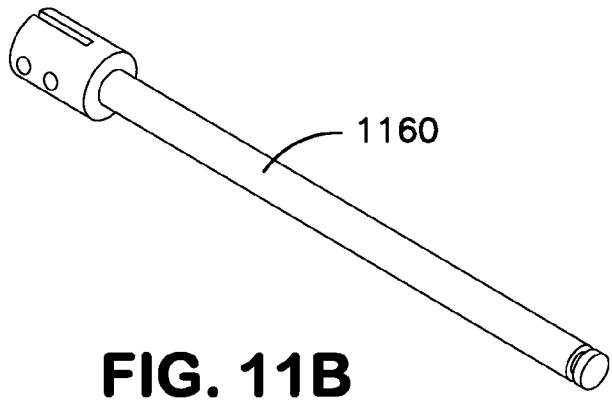
FIG. 11B shows a representative inner drive shaft.
Figure 11C:
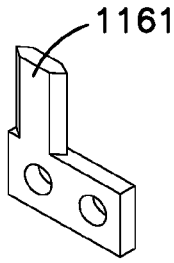
FIG. 11C shows a representative key.

FIGS. 11A, 11B, and 11C show the construction of a representative inner drive shaft and key (1100) comprising inner shaft (1160) and key (1161) in accordance with embodiments of the invention. In this embodiment, inner drive shaft and key (1100) is configured to communicate with rotor wheel(s) and an outer drive shaft to select and dispense reagents. One key (1100) is shown in this embodiment, however, inner drive shaft (1160) could be configured to accommodate additional keys (1100) to engage additional rotor wheels for simultaneous pumping of even additional multiple fluids. To select reagent(s), an inner drive shaft and key (1100) is positioned to communicate with rotor wheel(s) using means for positioning, such as by way of a lead screw powered by a reagent selector motor. To dispense reagent(s), an inner drive shaft and key (1100), which is positioned to communicate with selected rotor wheel(s), is rotated using means for dispensing reagent(s), such as by way of communication of key (1161) with an outer drive shaft powered by a dispense motor. Only rotor wheel(s) in communication with key (1161) will rotate with the outer drive shaft to dispense reagents. Additionally, an alignment plate prevents unselected reagents from being dispensed by communicating with and essentially locking unselected rotor wheels in place. By way of an alignment plate cut out, selected rotor wheel(s) are allowed to rotate.

Figure 12:
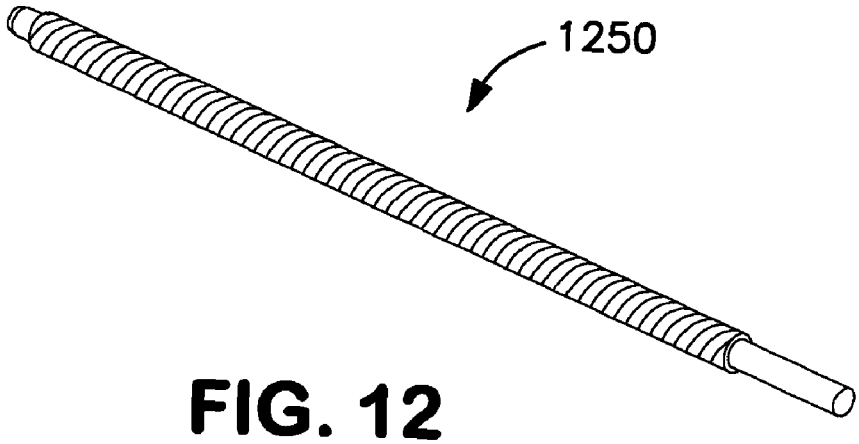
FIG. 12 shows a representative lead screw for a linear actuator for selecting reagent(s).

FIG. 12 shows a representative lead screw (1250). As discussed above with respect to other figures, lead screw (1250), in conjunction with a reagent selector motor, provides means for positioning an inner drive shaft and key, an alignment plate, and an alignment plate cut out to communicate with rotor wheels(s). Communication of an inner drive shaft and key (and corresponding alignment plate cut out) with desired rotor wheel(s) provides for selection and dispensing of desired reagents. Communication of an alignment plate with unselected rotor wheels prevents the unselected rotor wheels (and corresponding reagents) from being dispensed. Lead screw (1250), in conjunction with a reagent selector motor, moves an inner drive shaft and key laterally into position with the rotor wheel(s).

Figure 13:
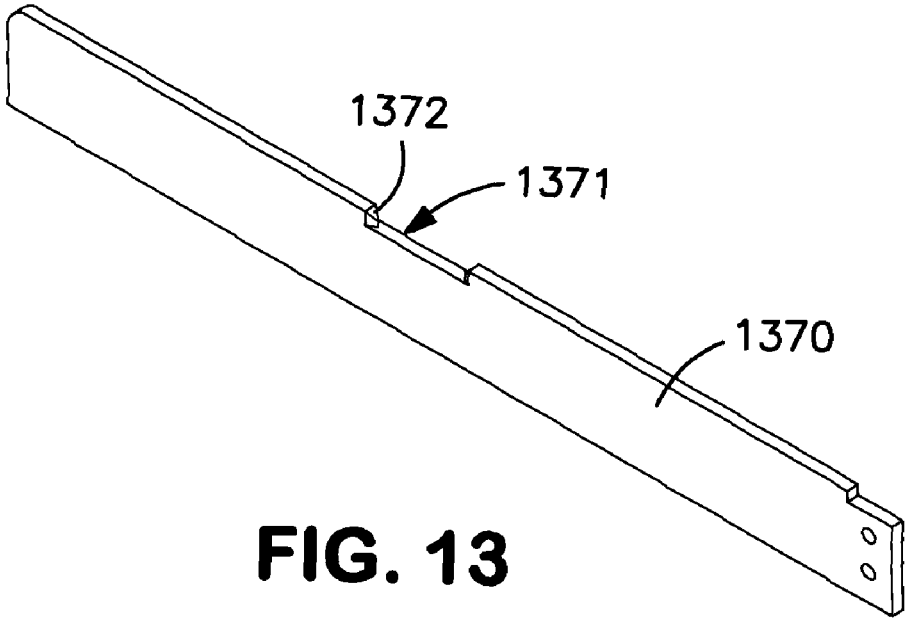
FIG. 13 shows a representative alignment plate with an alignment plate cut out.

FIG. 13 shows a representative alignment plate (1370) comprising an alignment plate cut out (1371). An alignment plate (1370) is positioned to prevent rotor wheels from rotating and dispensing reagent, whereas an alignment plate cut out (1371) is positioned below rotor wheel(s) that are in communication with a key to allow rotation of the selected rotor wheel(s) when dispensing the corresponding selected reagents. Edge (1372) in the context of this invention is understood to be part of alignment plate (1370) and likewise is positioned to prevent unselected rotor wheels from rotating during dispensing of fluid. Alignment plate (1370) also provides means for reducing the load on the outer shaft caused by pressure from the pressure housing asserted on unselected rotor wheels. Alignment plate (1370), thus, counter balances that pressure and reduces the overall radial load on the drive shaft. By countering the radial force of locked rotor wheels, alignment plate (1370) would allow for a smaller motor or less torque requirement of the motor.

Figure 14A:
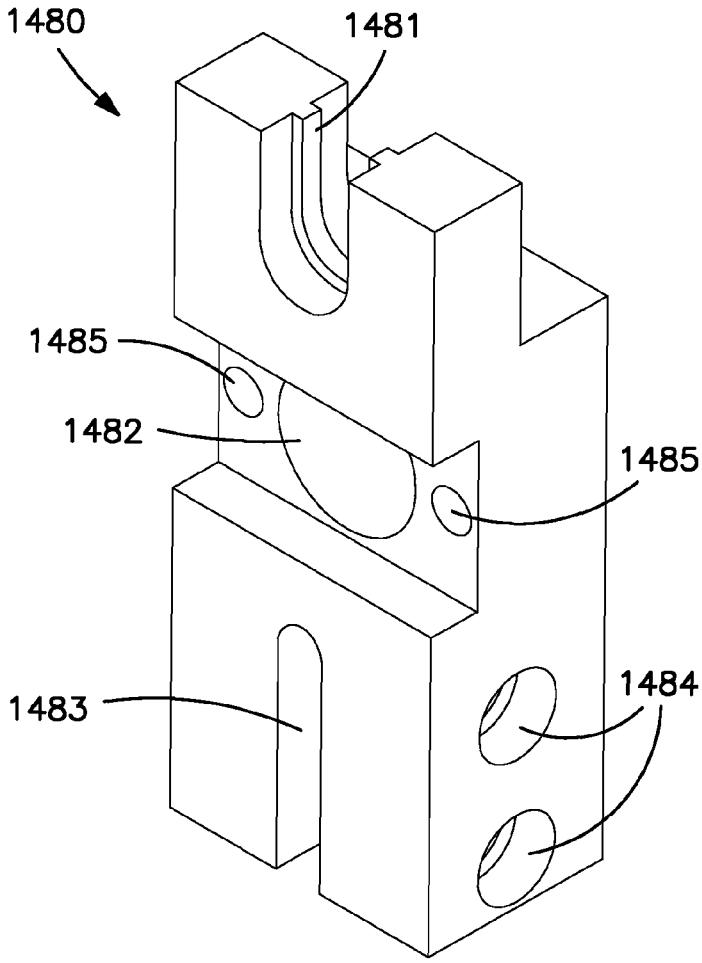
FIG. 14A is a representative support for the inner shaft, lead screw and nut, and alignment plate.
Figure 14B:
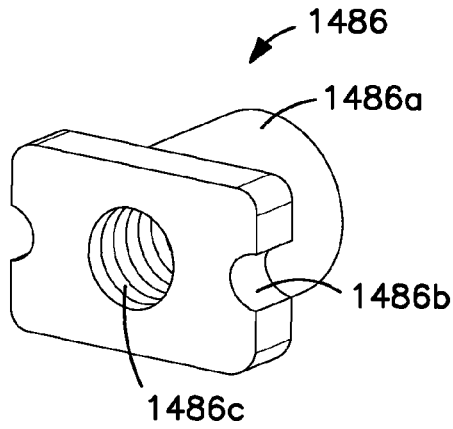
FIG. 14B is a representative screw nut for communication with the lead screw.

FIGS. 14A and 14B show a representative support (1480) and corresponding nut (1486). Support (1480) supports the right end of the inner drive shaft, lead screw, and alignment plate. More particularly, support (1480) provides support to an inner drive shaft by way of, for example, a U-shaped opening (1481). Opening (1481) supports the right end of an inner drive shaft so that the inner shaft can be moved laterally to position its key to communicate with selected rotor wheel (s). With respect to dispensing reagent(s), opening (1481) is configured so as to allow for the inner shaft to rotate when the key of the inner shaft is engaged (with the rotor wheel(s) and outer drive shaft) and rotated with the outer drive shaft to dispense reagent(s). Although other known configurations may be used to support the inner shaft, in this embodiment, a tongue and groove configuration between the inner shaft and support is exemplified, and any means may be used to provide means for positioning and rotating the inner shaft. This configuration allows for securing of the shaft while allowing rotation of the shaft. Of course, to reduce friction, other configurations may be used, such as those comprising ball bearings. Support (1480) also provides support to the lead screw at opening (1482) by way of nut (1486), shown in FIG. 14B. The tubular end (1486*a*) of nut (1486) is inserted into opening (1482) of support (1480) and is secured by any suitable means, for example, by screws that rest in screw recesses (1486*b*) and screw into screw holes (1485). The interior surface (1486*c*) of nut (1486) is threaded to communicate with the lead screw to cause lateral movement of support (1480) and consequently lateral movement of the inner drive shaft and alignment plate, which are also supported by support (1480). The alignment plate is fixed to support (1480) by being inserted into opening (1483) and fixed, for example, by way of screws through openings (1484).

Figure 15:
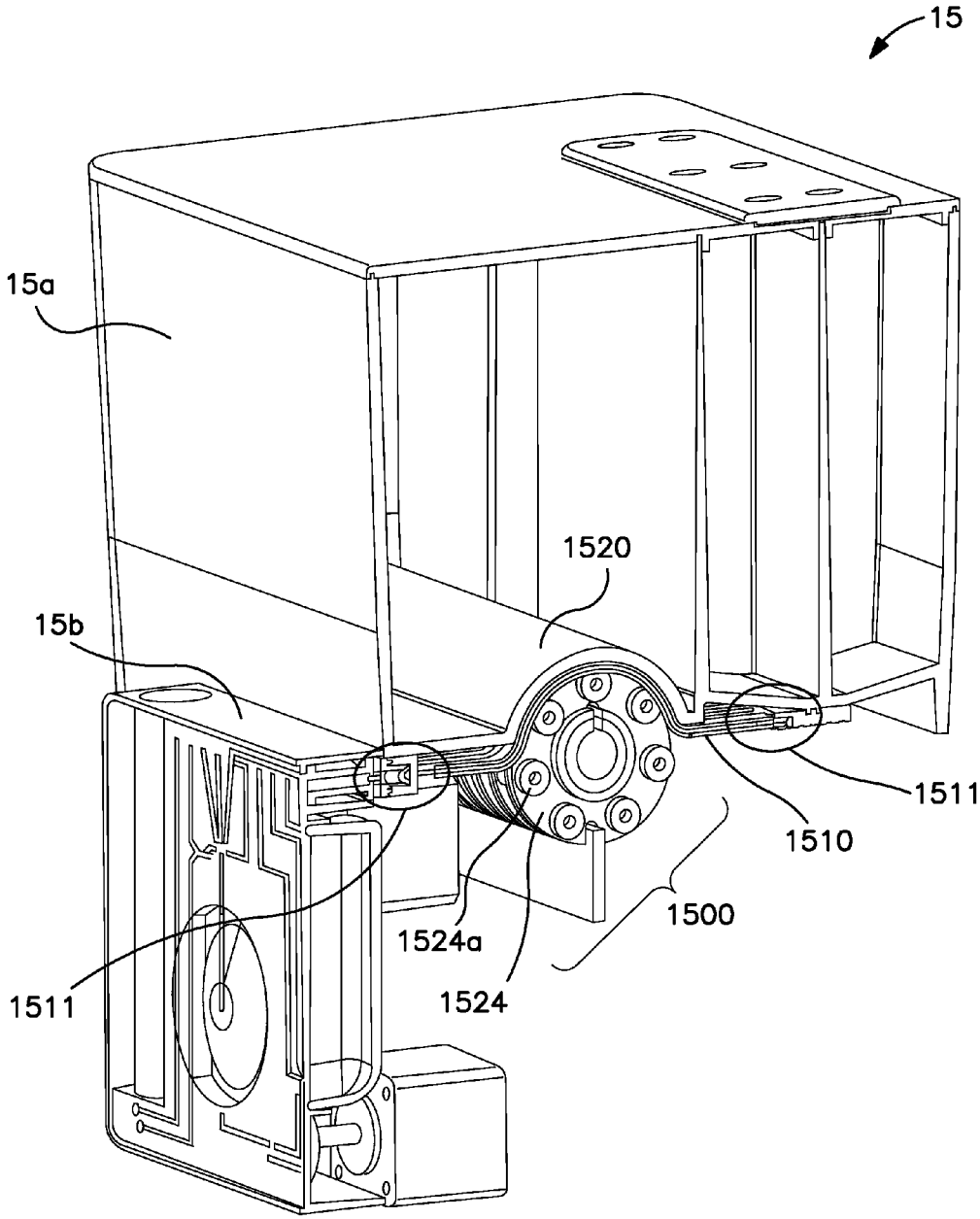
FIG. 15 is an exemplary embodiment of a system for purifying a substance of interest, e.g., a nucleic acid purification system, comprising a reagent pack, purification cartridge, and pump in accordance with the present invention.

FIG. 15 exemplifies one embodiment of a system for purifying a substance, e.g., a nucleic acid purification system, comprising a reagent pack, purification cartridge, and pump in accordance with the present invention. As shown, purification system (15) comprises reagent pack and waste receptacle (15*a*), purification cartridge (15*b*), and pump (1500). In this embodiment, pump (1500) is positioned below reagent pack (15*a*) and tubing (1510) is positioned between pump (1500) and reagent pack (15*a*), contacting both. Reagent pack (15*a*) comprises pressure housing (1520), which provides means for resisting pressure asserted on tubing (1510) during operation of pump (1500).

In particular, pressure housing (1520) provides resistance to pressure asserted on tubing (1510) by the rollers (1524*a*) of a rotor wheel (1524) during operation of pump (1500). During pump operation, rotor wheels (1524) are rotated and rollers (1524*a*) come into contact with and pinch or constrict tubing (1510) so as to impose a pressure on fluid contained within the tubing. Constriction of tubing (1510) is made possible due to the resistance provided by pressure housing (1520). Although in this embodiment pressure housing (1520) constitutes part of reagent pack and waste receptacle (15*a*), in accordance with the invention, pressure housing (1520) can also be an individual component of the system or an element of the pump. Pressure housing (1520) is a solid material, typically plastic or metal, however, any material that provides adequate resistance to the pressure asserted by rollers (1524*a*) would suffice.

Tubing (1510) mates with reagent pack (15*a*) at junction (1511) to form a fluid-tight seal at each of the tubes of tubing (1510). Such a connection allows for the passage of fluid from reagent pack (15*a*) into tubing (1510) when pumped by pump (1500), i.e., fluid is pulled from reagent pack (15*a*) through tubing (1510) into purification cartridge (15*b*). Pump (1500) pumps fluid contained in tubing (1510) by way of peristaltic pressure asserted by rollers (1524*a*). Likewise, fluid is pumped through tubing (1510) into purification cartridge (15*b*), i.e., fluid is pushed by pump (1500) and transported through junction (1511) into purification cartridge (15*b*). Junctions (1511) can be any connection suitable for connecting tubing (1510) to reagent pack (15*a*) and purification cartridge (15*b*), such as a male/female connection, so long as a fluid-tight seal is made between tubing (1510) and other components of the system.

Figure 16A:
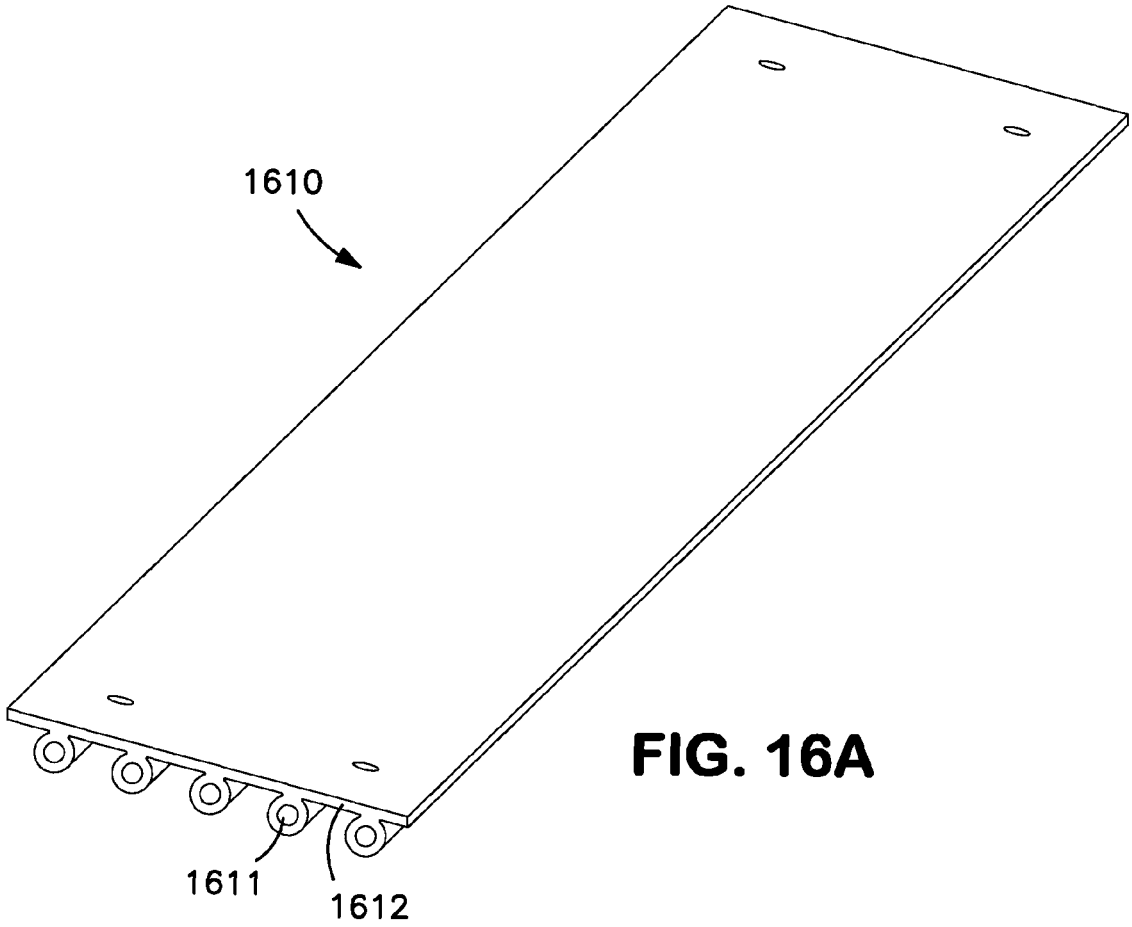
FIGS. 16A and 16B show representative tubing according to one embodiment of the invention, in particular, multi-channel, single-piece extruded tubing.
Figure 16B:
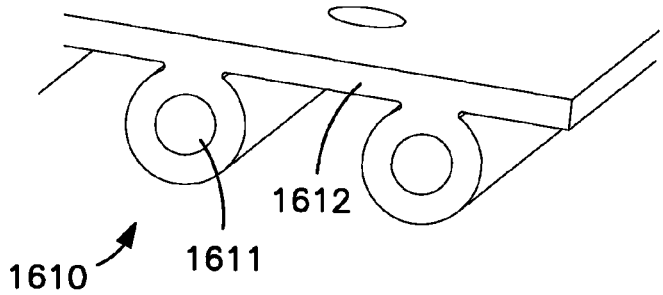

FIG. 16A shows representative tubing according to one embodiment of the invention, in particular, a multi-channel, single piece extruded tubing (1610). The tubing that can be used with the pumps in accordance with the invention can comprise single or multiple channels. The tubing can be made of any flexible material and is typically constructed of thermoplastic elastomer, such as Tygon® or silicon rubber. Tubing should be constructed so as to be resilient in nature, so that during operation of the pump the tubing has the capability of returning relatively quickly to its natural shape after being subjected to the pressure asserted by the rollers. Additionally, the tubing should be durable and not wear out too quickly. While not being limited to any particular chemical composition, tubing is typically selected based on the nature of fluids to flow through it. For example, for carrying aqueous fluids, the tubing may comprise norprene, neoprene, butyl rubber, gum rubber, silicone, polyvinyl chloride (PVC), polyethylene. Likewise, the inner and outer diameter of the tubing can be selected based on the volume of fluid to be pumped, the pressure desired within the tubing, and other parameters. Tubing channels can be individual or can comprise multi-channel tubing. Single-piece, multi-channel tubing may be advantageous in some applications in that, for example, a unified piece can facilitate loading and unloading of the tubing during loading of reagents or replacement of the tubing for wear. In FIG. 16A, five channels (1611) of a multi-channel, single piece extruded tubing are shown. Tubing channels (1611), in this embodiment, are joined by way of additional extruded material, which forms in essence a web (1612). Web (1612) may also function in conjunction with the pressure housing and/or reagent pack to provide pressure resistance to the tubing in response to pressure on the tubing by the rollers of the rotor wheels. FIG. 16B shows a close-up view of the channels (1611) of a single-piece, multi-channel extruded tubing.

Figure 16C:
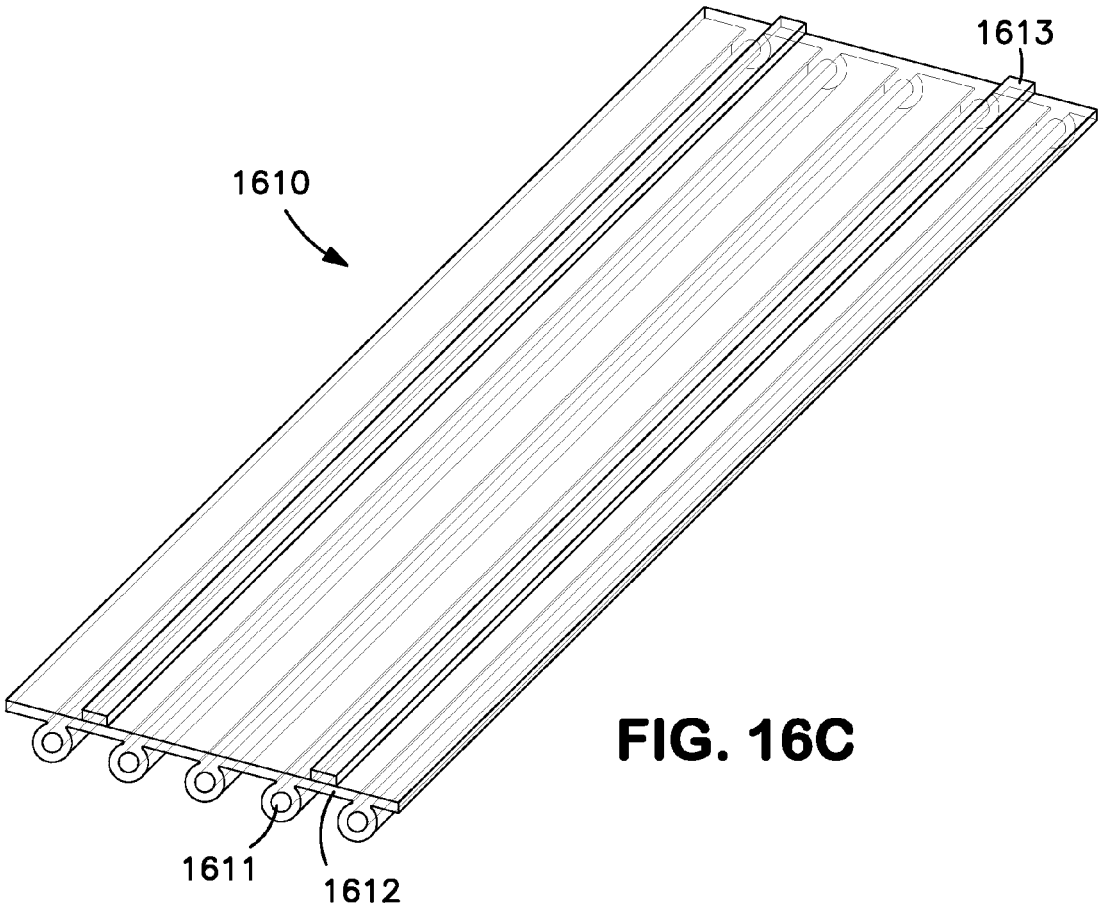
FIGS. 16C and 16D show representative multi-channel extruded tubing having structure for securing tubing to a pressure housing or reagent pack.
Figure 16D:
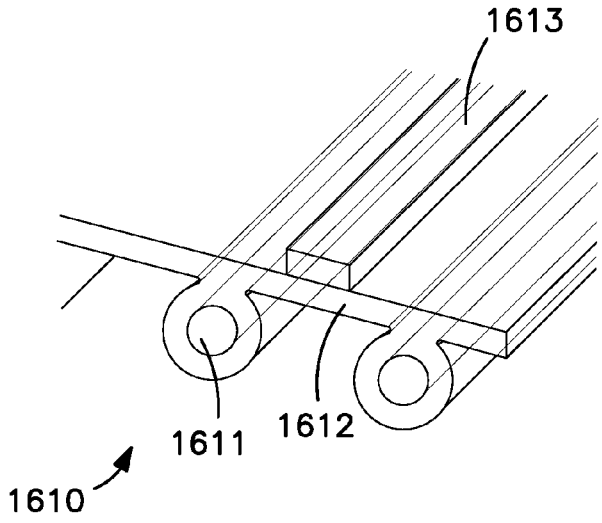

FIGS. 16C and 16D show multi-channel tubing having structure for engaging with a pressure housing or reagent pack. Such structure (1613) provides means for securing the tubing in place during operation of the pump and provides means for facilitating loading or replacing tubing by providing guidance for accurate positioning of the tubing on the rotor wheels of the pump. As shown, structure (1613) can comprise any configuration such as a tongue and groove configuration of any shape, such as rectangular. Structure (1613) will cooperate and engage with corresponding structure on the reagent pack or pressure housing. It is understood that the structure can also be incorporated into the pressure housing or reagent pack, while the corresponding structure is incorporated into the tubing. Other means for securing tubing can be used, such as an adhesive which fixes or secures tubing to reagent pack or pressure housing.

It will be apparent to those skilled in the art that various modifications and variations can be made in the practice of the present invention without departing from the scope or spirit of the invention. Other embodiments of the invention will be apparent to those skilled in the art from consideration of the specification and practice of the invention. It is intended that the specification and examples be considered as exemplary only, with a true scope and spirit of the invention being indicated by the following claims.

The invention claimed is:

1. A peristaltic pump comprising:

multiple rotor wheels for pumping fluid through at least one flexible channel;

a dual-shaft, concentric drive shaft for selecting and rotating at least one of said rotor wheels to pump said fluid through said at least one channel, said drive shaft comprising an inner shaft and an outer shaft;

a first motor for operating the inner shaft of the drive shaft; and a second motor for operating the outer shaft of the drive shaft.

2. The pump according to claim 1, wherein said motors are controlled by an electronic motor driver and a computing device.

3. The pump according to claim 1, further comprising an alignment plate for preventing rotation of unselected rotor wheels, wherein said alignment plate comprises an alignment plate notch for allowing rotation of selected rotor wheels.

4. The pump according to claim 1, wherein said dual-shaft, concentric drive shaft is capable of selecting and rotating two of said multiple rotor wheels to pump two fluids concurrently.

5. A peristaltic pump comprising a drive shaft capable of selecting and concurrently pumping more than one and less than all fluids present in multiple flexible channels that are in contact with multiple rotor wheels of the peristaltic pump, wherein the drive shaft comprises a dual-shaft, concentric drive shaft comprising and inner and an outer shaft, and wherein the peristaltic pump comprises a first motor for operating the inner shaft and a second motor for operating the outer shaft.

6. A peristaltic pump comprising:

multiple rotor wheels for pumping fluid through at least one flexible channel, each rotor wheel comprising an exterior surface and a substantially cylindrical interior surface, wherein each of said surfaces comprises an engagement notch;

an outer drive shaft concentric to said interior surface of said rotor wheels, wherein said outer drive shaft comprises a length-wise engagement notch;

an inner drive shaft concentric to said outer drive shaft, wherein said inner drive shaft comprises a structure for engagement with said interior surface notch of said rotor wheels for selecting said rotor wheels, and with said length-wise notch of said outer drive shaft for rotating said rotor wheels when engaged by said structure, and an alignment plate for engagement with said rotor wheel exterior surface notch, for preventing rotation of rotor wheels not engaged by said inner drive shaft structure, and comprising an alignment plate notch for engagement with said rotor wheel exterior surface, for allowing rotation of said rotor wheels engaged by said inner drive shaft structure.

7. The pump according to claim 6, wherein said dual-shaft, concentric drive shaft is capable of selecting and rotating two of said multiple rotor wheels to pump two fluids concurrently.

8. The pump according to claim 6 further comprising:

a first motor for selecting fluid by laterally positioning said inner drive shaft structure for engagement with at least one of said rotor wheel interior surface notch; and a second motor for pumping fluid by rotating said outer drive shaft, which rotates said inner drive shaft structure engaged with said outer drive shaft length-wise notch, which rotates said rotor wheels engaged by said inner drive shaft structure.

9. The pump according to claim 6, wherein said at least one flexible channel comprises single-piece extruded tubing capable of engaging and disengaging with said pump.

10. A system for purifying a substance of interest comprising:

a reagent receptacle for storing fluids for movement through said system;

a purification unit for purifying a substance of interest; and the peristaltic pump according to claim 6.

11. The system according to claim 10, wherein said at least one flexible channel comprises single-piece extruded tubing capable of engaging and disengaging with said pump.

12. The system according to claim 10, wherein said dual-shaft, concentric drive shaft is capable of selecting and rotating two of said multiple rotor wheels to pump two fluids concurrently.

13. A method of pumping fluid using a peristaltic pump, said method comprising:

operating a peristaltic pump comprising a dual-shaft, concentric drive shaft to select and rotate at least one of multiple rotor wheels for pumping fluid through at least one flexible channel, wherein the drive shaft comprises an inner shaft operated by a first motor and an outer shaft operated by a second motor.

14. The method according to claim 13, wherein said operating is performed by one or more motors controlled by an electronic motor driver and a computing device.

15. A method of pumping fluid using a peristaltic pump, said method comprising:

operating a peristaltic pump comprising:

multiple rotor wheels for pumping fluid through at least one flexible channel, each rotor wheel comprising an exterior surface and a substantially cylindrical interior surface, wherein each of said surfaces comprises an engagement notch;

an outer drive shaft concentric to said interior surface of said rotor wheels, wherein said outer drive shaft comprises a length-wise engagement notch;

an inner drive shaft concentric to said outer drive shaft, wherein said inner drive shaft comprises a structure for engagement with said interior surface notch of said rotor wheels for selecting said rotor wheels, and with said length-wise notch of said outer drive shaft for rotating said rotor wheels when engaged by said structure, and an alignment plate for engagement with said rotor wheel exterior surface notch, for preventing rotation of rotor wheels not engaged by said inner drive shaft structure, and comprising an alignment plate notch for engagement with said rotor wheel exterior surface, for allowing rotation of said rotor wheels engaged by said inner drive shaft structure.

16. The method according to claim 15, wherein said operating is performed by one or more motors controlled by an electronic motor driver and a computing device.

17. A system for purifying a substance of interest comprising:

a reagent receptacle for storing fluids for movement through said system;

a purification unit for purifying a substance of interest; and the peristaltic pump according to claim 1.

18. The system according to claim 17, wherein said at least one flexible channel comprises single-piece extruded tubing capable of engaging and disengaging with said pump.

19. The system according to claim 17, wherein said dual-shaft, concentric drive shaft is capable of selecting and rotating two of said multiple rotor wheels to pump two fluids concurrently.

* * * * *